US009629412B2

(12) United States Patent
Wang

(10) Patent No.: US 9,629,412 B2
(45) Date of Patent: Apr. 25, 2017

(54) FLOCK SOLE, ITS MACHINE OF MANUFACTURE AND ITS PRODUCTION METHOD

(71) Applicant: Dongguan Fu Ma Shoes Material Co., Ltd., Dongguan (CN)

(72) Inventor: Pengtao Wang, Dongguan (CN)

(73) Assignee: DONGGUAN FU MA SHOES MATERIAL CO., LTD., Dongguan (CN)

( * ) Notice: Subject to any disclaimer, the term of this patent is extended or adjusted under 35 U.S.C. 154(b) by 55 days.

(21) Appl. No.: 14/536,349

(22) Filed: Nov. 7, 2014

(65) Prior Publication Data

US 2016/0058106 A1 Mar. 3, 2016

(30) Foreign Application Priority Data

Aug. 28, 2014 (CN) ..... 2014 1 0431585

(51) Int. Cl.

| | |
|---|---|
| ***A43B 13/02*** | (2006.01) |
| ***B05D 1/04*** | (2006.01) |
| ***B05D 1/14*** | (2006.01) |
| ***B05D 1/16*** | (2006.01) |
| ***A43B 3/00*** | (2006.01) |
| ***B05D 1/06*** | (2006.01) |
| ***B05C 19/00*** | (2006.01) |

(Continued)

(52) U.S. Cl.

CPC ..... *A43B 3/0084* (2013.01); *A43B 13/02* (2013.01); *A43D 8/16* (2013.01); *A43D 25/18* (2013.01); *B05C 19/002* (2013.01); *B05D 1/06* (2013.01); *B05D 1/14* (2013.01); *B05D 1/16* (2013.01); *Y10T 428/23943* (2015.04)

(58) Field of Classification Search

CPC ..... A43B 13/02; A43B 13/12; A43B 13/122; A43B 13/22; A43B 13/223; B32B 7/12; B05C 19/001; B05C 19/002; B05D 1/007; B05D 1/04; B05D 1/045; B05D 1/06; B05D 1/14; B05D 1/16; Y10T 428/23943

See application file for complete search history.

(56) References Cited

U.S. PATENT DOCUMENTS 2,881,087 A * 4/1959 Schwartz ..... B05C 19/001 118/57
3,099,514 A * 7/1963 Haber ..... D06C 23/00 8/115.6

(Continued)

*Primary Examiner* — Michael Tolin
(74) *Attorney, Agent, or Firm* — Shimokaji IP

(57) ABSTRACT

The invention covers both the sole structure and its related production equipment and technology, especially in relation to a type of flocked shoe sole. Compared with the existing technology, the shoe sole can trap and retain fiber particles via electrostatic or electrostatic spraying, which is not only anti-slippery also with elegant looking and reduce the cost. This set of equipment for making flocked sole is highly automatic, easy to operate, save the labor and reduce the production cost. The production procedure consists of 1) applying prime coating; 2) applying adhesive; 3) natural flock retention or electrostatic flocking; 4) electrostatic separation, cleaning, pairing and packaging. The whole process has been shortened dramatically, simplify the procedure, and reduce the cost. Also the solvent and adhesive used are both environmental friendly, harmless, which helps increase the productivity and yield.

7 Claims, 4 Drawing Sheets

(51) Int. Cl.
*A43D 8/16* (2006.01)
*A43D 25/18* (2006.01)

(56) References Cited

U.S. PATENT DOCUMENTS

| | | | | | |
|---|---|---|---|---|---|
| 3,403,817 | A * | 10/1968 | Morash | B05D 1/16 | 118/308 |
| 4,899,411 | A * | 2/1990 | Johnson | A43B 3/0084 | 12/142 E |
| 7,056,558 | B2 * | 6/2006 | Daniels | A43B 3/0084 | 427/462 |
| 2008/0318037 | A1 * | 12/2008 | Maral | A43B 13/04 | 428/339 |
| 2011/0283567 | A1 * | 11/2011 | Yin | A43B 3/0078 | 36/30 R |
| 2014/0093655 | A1 * | 4/2014 | Makover | A43D 111/00 | 427/558 |

* cited by examiner

FLOCK SOLE, ITS MACHINE OF MANUFACTURE AND ITS PRODUCTION METHOD

CROSS REFERENCE OF RELATED APPLICATION

This is a non-provisional application which claims foreign application number 201410431585.2 with a filing date of Aug. 28, 2014 in China. The contents of this specification, including any intervening amendments thereto, are incorporated herein by reference.

BACKGROUND OF THE PRESENT INVENTION

Field of Invention

This invention relates to a sole structure and its associated production technology and equipment, and particularly to a flocked sole and its related production equipment and technology.

Description of Related Art

The bottom of a shoe gets in touch with ground surface directly. So it requires better gripping and friction. In order to increase the friction, China patent no. CN101849726A disclosed a sole and its making method to covering the sole bottom with fibre particles via adhesive with the following steps: Step 1: cover the bottom of the sole that needn't be glued with fibre particles; Step 2: the section of the sole to be flocked should be covered too; Step 3: send the sole where its surface has been treated by TPR solvent and get it dried at a temperature between 60-65 Celsius for 4-20 minutes; Step 4: apply adhesive to the section of the sole where requires flocking; Step 5: send the soles coated with adhesive into oven and leave it half dry at a temperature 60-65 Celsius for 4-20 minutes; Step 6: choose qualified flock (fibre particle); Step 7: spray the quality fibre particles evenly on adhesive coated surface; Step 8: get rid of the excessive flocks on the sole; Step 9: send the soles after step 8 treatment into an oven, where contains fogging agent inside, at a temperature of 60-65 Celsius for 4-20 minutes; Step 10: remove the soles from step 9 for cleaning and packaging.

The above method requires a very long production line, occupying a lot space, low automation, which means low productivity, more manpower and materials consumed and higher cost. Especially Step 7, fiber particles are stored inside a spray gun. The particles are shot out by pressure gun and applied on the special adhesive. For the soles with grooves, where most part of the surface is flat, it is difficult to guarantee the particles are evenly spread and retained. The production yield is quite low too and not economic.

So there is a demand for a new flocked sole and its associated production equipment and technology, which will overcome the disadvantages of the present technique.

SUMMARY OF THE PRESENT INVENTION

The objective of this invention is to provide a flocked sole, which is not only anti-slippery but also with nice looking and reducing the production cost Another objective of this invention is to provide a flocked sole making equipment with features of high automation, simple operations, save the labour and then reduce the production cost.

Another objective for this invention is to provide a production process with better productivity, yield and economic benefits.

In order to realize above objectives, the following technical method has been adopted:

A flocked sole includes sole itself. The bottom of the sole has groove or front part of the sole surface is flat; the sole can attract flock naturally or via electrostatic flocking.

A full set equipment making flocked soles include prime coating, adhesive application, electrostatic flocking, electrostatic separation and oven are all laid along the same production pipeline. The electrostatic flocking machine includes hollow electrostatic box and an electrostatic grid placed inside the box. A flock spreader is attached and connected on top of the electrostatic box. There is at least one brush inside the flock spreading machine.

Preferably, the electronic brush is made up from both soft and hard bristles and the bristles are laid vertically along the axle, the brush will spin automatically under the driving of a motor;

Preferably, there is a recycling bin attached beneath the electrostatic box;

Preferably, there is an electrostatic separation box, which is made up of one hollow box with an electrostatic grid inside;

Preferably, the said electrostatic box has a dust collector attached;

Preferably, the system comprises of control box and electrostatic generator. There are control buttons on the panel of control box.

The full production procedure of a flocked sole includes following steps:

Step 1: apply a layer of solvent by brushing or spraying: apply the section of the sole where it is going to attract flocks with solvent and let it air dry;

Step 2: apply adhesive: spray adhesive on the prime coating as stated on step 1;

Step 3: attract fibre naturally or via electrostatic;

The soles after step 2 treatment will be sent into electrostatic box. There are fibre particles inside the flock spreader. Those fibre particles are blended loosely and evenly, falling through electrostatic box, the electrostatic grid will generate electrostatic, at the effect of the generated electrostatic, the fibre particles will be evenly spreading across the sole surface bearing adhesive, the un-used or trapped fibre particles will fall back to the recycling box beneath. Or under pressure, the fibre particle may be trapped or stuck on the adhesive coated surface. The said pressure is ranging between 0.1-0.5 MPa.

Step 4: Electrostatic separation, cleaning and packaging.

The soles after step 3 treatment will be sent through electrostatic separation box, where those fibre particles that haven't be trapped or stuck firmly by the adhesive will be sucked away or removed by electrostatic generated by electrostatic grid. The removed loose fibre particles will be collected by dust collector and sent back to an oven with a temperature of 65 to 75 Celsius degree and dried for 3-15 minutes. Afterwards, any residual loose fibre particles or excessive adhesive will be finally cleaned or wiped away. Then the soles will be paired and packaged.

Preferably, the solvent used in step 1 is RB31 and the adhesive used in step 2 is water based either TX-7 or R255.

Preferably, as stated in above step 1, the sole surface with shallow groove, the prime coating is applied by brushing. The deeper groove will be prime treated by spray.

The present invention discloses a sole with flock finish and its associated production equipment and technology.

Compared with existing technology, the shoe sole can trap fibre particles via electrostatic or electrostatic spraying, which is not only anti-slippery also with elegant looking and reduce the cost. This set of equipment for making flocked sole is highly automatic, easy to operate, save the labour and reduce the production cost. The main production procedure consists of 1) apply prime coating; 2) apply adhesive; 3) natural trap or electrostatic flocking; 4) electrostatic separation, cleaning, pairing and packaging. The whole process has been shorten dramatically, simplified the procedure, reduced the cost. Also the solvent and adhesive used are all environmental friendly, harmless, which helps increase the productivity and yield.

Additional advantages and features of the invention will become apparent from the description which follows, and may be implemented by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

We hereby explain this invention in further details by several embodiments, which is a preferable example in real practice.

Embodiment 1

Figure 1:
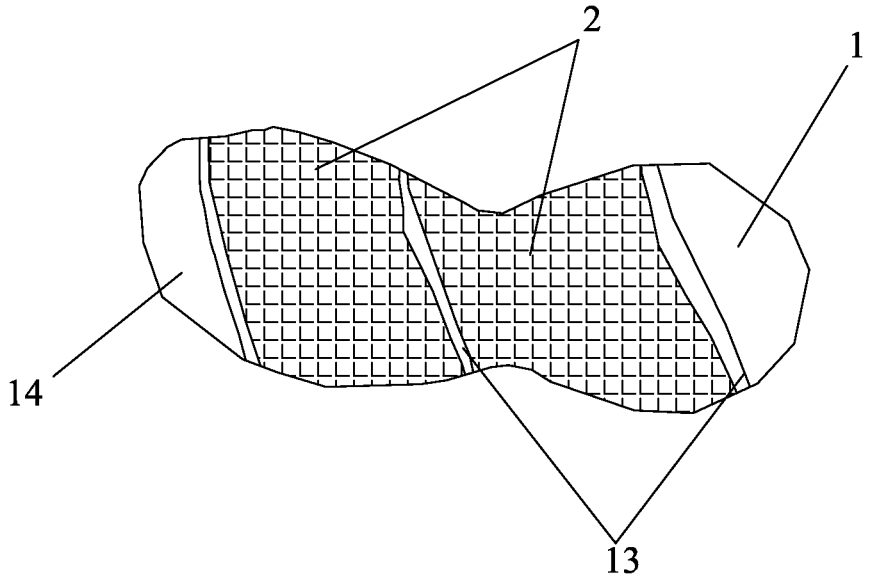
FIG. 1 illustrates a structure of a flocked outsole according to a preferred embodiment of the present invention.

FIG. 1: This is a structural illustration of a flocked sole. As indicated in FIG. 1, this is a sole with flocking finish, it includes the sole body 1, the bottom of the sole bears grooves 13 and the front section of the bottom is flat surface 14. The said sole bottom attracts fibre particles, which are the flock members, naturally or via electrostatic flocking. The electrostatic flocking includes attracting the flock members via static electricity or via electrostatic spraying. The grooves 13 have different depth. The flock members, which is preferably fiber particles, can increase the friction coefficient and provide anti-slippery function while enhancing the appearance as well as lowering the production cost.

Embodiment 2

Figure 2:
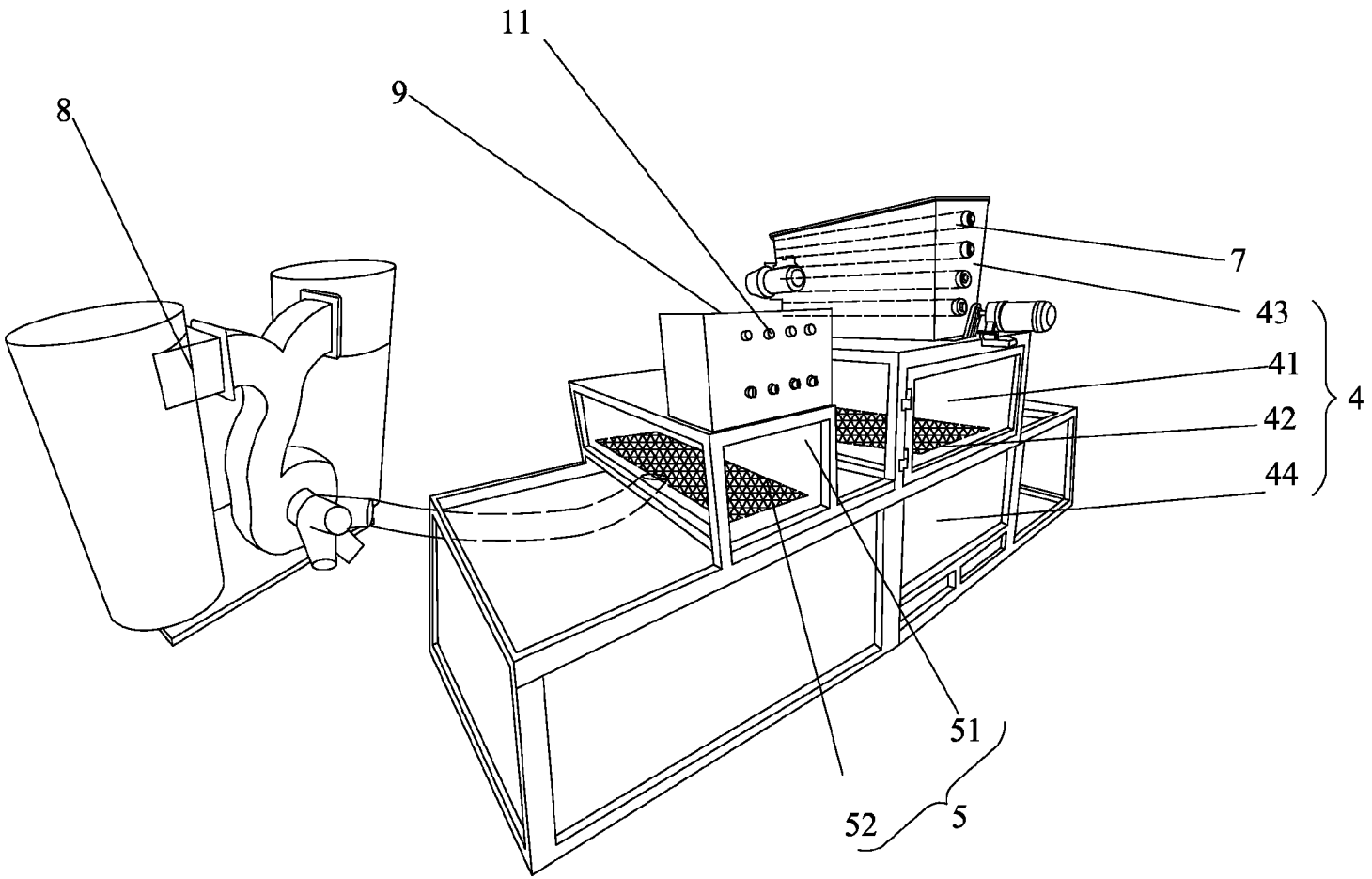
FIG. 2 illustrates a structure of a full set of flocked sole making machine according to the preferred embodiment of the present invention.
Figure 3:
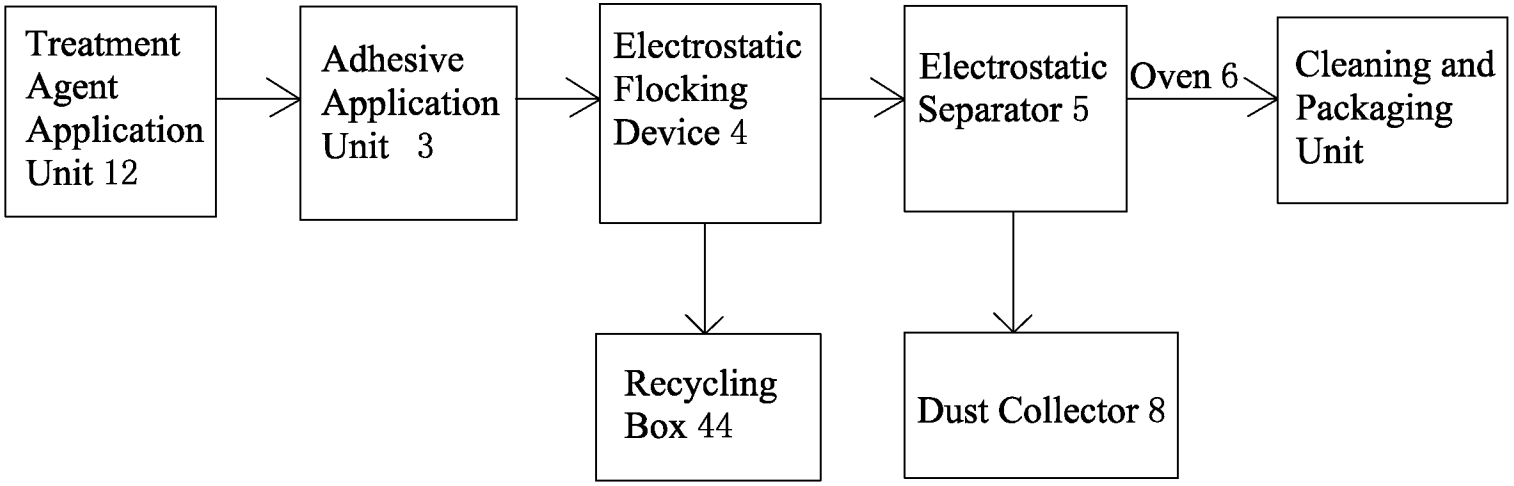
FIG. 3 is a flow chart of a flocked sole making machine and its configuration according to the preferred embodiment of the present invention.

As indicated in FIG. 2-3, a whole set of flocked sole making machine comprises a treatment agent application unit 12, an adhesive application unit 3, an electrostatic flocking device 4, an electrostatic separation device 5 and an oven 6. The treatment agent application unit 12, the adhesive application unit 3, the electrostatic flocking device 4, the electrostatic separation device 5 and the oven 6 are aligned on the same production line. The electrostatic flocking device 4 comprises a hollow electrostatic box 41 and an electrostatic grid member 42 inside the electrostatic box 41. On top of the electrostatic box 41, a flock spreader 43 which is connecting to the electrostatic box 41 is positioned. Inside the flock spreader 43, there is at least one brush 7. The oven 6, the treatment agent application unit 12 and the adhesive application unit 13 are not indicated on the illustration. Preferably, each of the treatment solution application unit 12 and the adhesive application unit 13 comprises a spray gun.

According to the preferred embodiment of the present invention, the brush 7 includes both soft and hard bristles and the brush 7 is longitudinally aligned. This brush 7 is driven by a motor and spins inside the flock spreader. The soft bristles blend the fiber particles evenly and the hard bristles loosen the fiber particles, which prevent the flock spreader from being blocked by the flock (which is the fiber particles). The speed and volume of fibre particles are controlled by adjusting the opening of the spreader 43 and the blending speed of the brush 7. This ensures the evenness of the fibre particles.

According to the preferred embodiment of the present invention, beneath electrostatic box 41 there is a recycling box 44, which collects all of the loose particles that are not attracted and flocked to the soles. This recycle process reduces the waste to the maximum and keeps the production studio clean and tidy rather than have the fibre particles flying everywhere.

According to the preferred embodiment of the present invention, the said electrostatic separator 5 consists of a hollow electrostatic separation box 51 and inside it there is an electrostatic grid 52. This electrostatic separation box is connected with a loose particle collector such as a dust collector 8. When passing through the electrostatic grid 52, the loosen particles on the sole will be separated and come off from the sole and collected by the particle collector and recycled.

According to the preferred embodiment of the present invention, this set of equipment includes a control box 9 and electrostatic generator 10 (not shown on the FIGs). On the control box 9, there are control buttons 11, which control and regulate flock spreader 43, electrostatic box 41, electrostatic separation box 51 and loose particle collector 8. Electrostatic generator 10 is cabled with electrostatic box 41 and electrostatic separation box 51.

Embodiment 3

Figure 4:
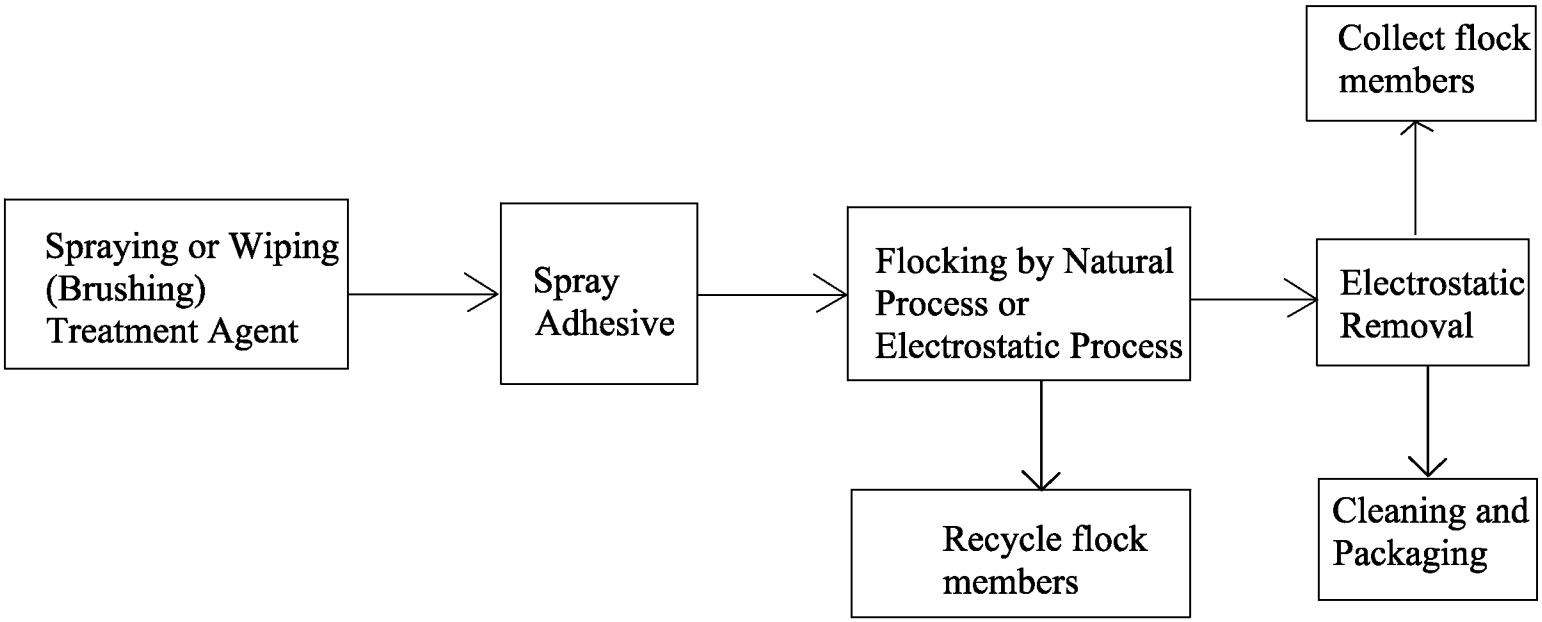
FIG. 4 is a production process of a flocked sole production according to the preferred embodiment of the present invention.

According to the preferred embodiment of the present invention as illustrated in FIG. 4, a flocked sole making equipment and technology include the following production steps:

Step 1: wiping or spraying treatment agent:

apply the section of the sole where it is going to attract flocks with treatment agent such as a solvent and let it air dry;

Step 2: apply adhesive;

Apply a layer of adhesive onto the portion at which the treatment agent is applied by using the adhesive spray gun of the adhesive application unit;

Step 3: attract fibre naturally or via electrostatic;

The soles after step 2 treatment will be sent into electrostatic box; There are fibre particles inside the flock spreader. Those fibre particles are blended loosely and evenly, falling through electrostatic box, the electrostatic grid will generate electrostatic, at the effect of the generated electrostatic, the fibre particles will be evenly spreading across the sole surface bearing adhesive, the un-used or trapped fibre particles will fall back to the recycling box beneath. Or under pressure, the fibre particle may be trapped or stuck on the adhesive coated surface. The said pressure is ranging between 0.1-0.5 MPa;

Step 4: Electrostatic separation, cleaning and packaging

The soles after step 3 treatment will be sent through electrostatic separation box, where those fibre particles that haven't be trapped or stuck firmly by the adhesive will be sucked away or removed by electrostatic generated by electrostatic grid. The removed loose fibre particles will be collected by dust collector and sent back to an oven with a temperature of 65 to 75° C. and dried for 3-15 minutes. Afterwards, any residual loose fibre particles or excessive adhesive will be finally cleaned or wiped away. Then the soles will be paired and packaged.

According to the preferred embodiment of the present invention, the solvent selected from prime coating as stated in Step 1 should be RB31 solvent, the type of adhesive stated in Step 2 should be TX-7 water based adhesive or R255 water based adhesive. The shoe soles are can be made from different materials, i.e. rubber, EVA, PU, TPR or syndicate rubber, RB31 solvent or any other available solvent can be used for prime coating. This solvent can increase the adhesive strength dramatically; The adhesive can be either TX-7 or R255 water based one. Alternatively, other available adhesive can be chosen for this purpose according to the sole material.

According to the preferred embodiment of the present invention, it should be pointed out again that as stated in step 1, for the sole bottom with shallow groove, the prime coating should be applied by brush and by spray operations for the sole with deeper groove.

Finally, it should be addressed that above practical example is for demonstrating this new technical solution. It is not to limit the protection scope of this new invention. Although the detailed explanation and demonstration has been given based on the example mentioned as above. The technician and engineers working in this industry should understand that they can modify or substitute this new technical solution, but any modification or substitution shouldn't deviate from the nature and scope of this solution.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An apparatus for manufacturing a flocked sole, said apparatus comprising:
- a treatment solution application unit,
- an adhesive application unit,
- an electrostatic flocking device,
- an electrostatic separation device, and
- an oven,
- wherein said treatment solution application unit, said adhesive application unit, said electrostatic flocking device, said electrostatic separation device and said oven are aligned along a production line,
- wherein said electrostatic flocking device comprises:
- a hollow electrostatic box,
- an electrostatic grid member inside said hollow electrostatic box,
- a flock spreader attached and connected on top of said electrostatic box, and
- at least one brush inside said flock spreader, wherein said brush comprises a soft bristle member and a hard bristle member.

2. An apparatus for manufacturing a flocked sole according to claim 1, characterized in that:
- said treatment solution application unit comprises a solvent spray gun.

3. An apparatus for manufacturing a flocked sole according to claim 1, characterized in that:
- said adhesive application unit comprises an adhesive spray gun.

4. An apparatus for manufacturing a flocked sole according to claim 1, characterized in that:
- the electrostatic box comprises a recycle bin at a bottom portion of the electrostatic box.

5. An apparatus for manufacturing a flocked sole according to claim 1, characterized in that:
- the electrostatic separation device comprises a hollow electrostatic separation box with an electrostatic grid fitted inside said hollow electrostatic separation box.

6. An apparatus for manufacturing a flocked sole according to claim 5, further comprising:
- a dust collector connected to said electrostatic separation box.

7. An apparatus for manufacturing a flocked sole according to claim 1, further comprising:
- a motor, wherein said brush members are longitudinally aligned and are driven by the motor to rotate in said flock spreader.

* * * * *